United States Patent [19]

Crist

[11] 4,026,470

[45] May 31, 1977

[54] SHOWER FLOW MODULATOR

[75] Inventor: Buckley Crist, Plainfield, N.J.

[73] Assignee: Jaclo, Inc., Brooklyn, N.Y.

[22] Filed: Nov. 14, 1975

[21] Appl. No.: 631,879

[52] U.S. Cl. ..... 239/102; 239/382; 239/DIG. 5

[51] Int. Cl.[2] ..... B05B 3/14

[58] Field of Search ..... 239/101, 102, 381, 383, 239/389, 452, 590, DIG. 5, 382

[56] References Cited

UNITED STATES PATENTS

| | | | |
|---|---|---|---|
| 613,623 | 11/1898 | Dolan | 239/101 |
| 3,664,585 | 5/1972 | Curtis | 239/281 X |
| 3,929,287 | 12/1975 | Givler et al. | 239/102 |

*Primary Examiner*—Evon C. Blunk
*Assistant Examiner*—Michael Mar
*Attorney, Agent, or Firm*—Gottlieb, Rackman & Reisman

[57] ABSTRACT

A shower flow modulator for providing a massaging effect on the skin of a shower user is adapted to fit within the stem of a shower nozzle for modulating the flow of water leaving the nozzle. The shower flow modulator includes a hydrodynamically-shaped member which is attracted into and then repulsed from a stream of water passing through the modulator thereby varying the direction of travel and intensity of the stream to provide the massaging action.

20 Claims, 6 Drawing Figures

SHOWER FLOW MODULATOR

This invention relates generally to shower nozzles for providing a massaging action on the skin of a shower user and, more particularly, to a shower flow modulator adapted to cooperate with a shower nozzle for varying the intensity of flow and direction of flow of water exiting from the nozzle to provide the "massaging" action.

Over the past several years, a market demand has been created for shower nozzles that "pulse" one or more streams of water to produce a massaging effect on the skin of a shower user. One such shower or spray nozzle is described in U.S. Pat. No. 3,762,648, which issued on Oct. 2, 1973 to Deines, et al. This patent discloses a shower or spray nozzle which delivers an intermittent, interrupted or pulsating spray to the user's skin by the use of a turbine blade assembly which directs the water flow against a rotatable valve rotor. Although the shower nozzle disclosed in this patent has met with some success, it has been less than satisfactory for several reasons.

First, the shower nozzle disclosed in the above patent is quite complex in configuration, with numerous moving parts. The resulting nozzle is thus expensive to manufacture and may be prone to malfunction when in use. Furthermore, the shower nozzle disclosed in this patent is representative of nozzles disclosed in the prior art which operate on the principle of actually interrupting the stream of water which exits from the nozzle. Although this does produce a massaging effect, it has been found that interruption of the fluid flow is somewhat irritating to the shower user.

Accordingly, it is a broad object of the present invention to provide a shower flow modulator which overcomes the difficulties of massaging shower nozzles of the prior art.

Another object of this invention is to provide a shower flow modulator which includes only a single moving part, thereby providing ease of operation and decreased manufacturing costs.

Another object of this invention is to provide a shower flow modulator which provides a continuous stream of water, thereby providing a massaging effect on the user which is less irritating then the interrupted-type water flow massaging nozzles of the prior art.

Yet another object of the present invention is to provide a shower flow modulator which is not subject to the problems of clogging, mineral build-up and excessive wear and which may be easily inserted into a shower or spray nozzle.

These and other objects of the present invention are obtained by providing a shower flow modulator adapted to fit into the stem of a shower nozzle. The shower flow modulator includes a housing defining a top channel and a bottom chamber. A passageway and supporting member, disposed between the top channel and the bottom chamber, defines a plurality of water passageways for directing water from the top channel to the bottom chamber. The passageway and supporting member also supports a hydrodynamically-shaped member which is partially disposed within the bottom chamber and which is adapted to swing into and out of the streams or jets of water exiting from the water passageways. Oscillation of the hydrodynamically-shaped member, caused by the attractive-repulsive action of the hydrodynamically-shaped member relative to the streams, varies the direction and the intensity of the water exiting from the modulator thereby providing a pleasant massaging effect on the skin of the shower user.

The above brief description of the present invention will be more fully appreciated by reference to the following detailed description of a presently preferred, but nonetheless illustrative, embodiment of the present invention, when taken in conjunction with the following drawing, wherein.

Figure 1:
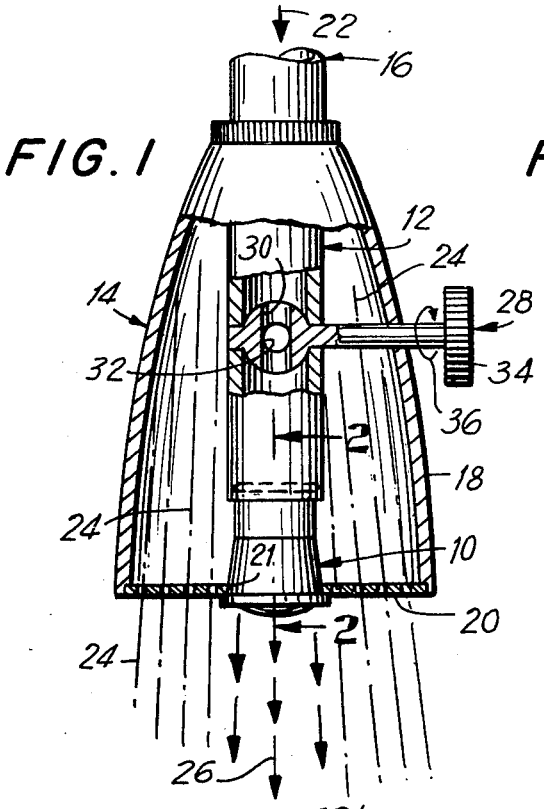
FIG. 1 is a front elevation view, partly broken away, showing a shower nozzle adapted to receive a shower flow modulator according to the present invention.

Referring now to the drawing and, more particularly, to FIGS. 1–4 thereof, a shower flow modulator according to the present invention is generally designed 10. Shower flow modulator 10 is disposed within a stem 12 of a conventional shower nozzle 14, the nozzle adapted to be connected to a water outlet or fixture 16, for example, as part of an overhead shower or the like.

As illustrated in FIG. 1, shower nozzle 14 includes an outer casing or shield 18, which surrounds stem 12, and a grating 20 which allows water received from fixture 16 (see arrow 22) to be directed by the shield onto the skin of a person standing beneath the shower nozzle, as indicated by the flow of jets of water 24. Shower flow modulator 10, which extends though an appropriate opening 21 in grating 20, functions to modulate those water jets or streams 26 which flow to the flow modulator and then to the skin of a user, as will be explained hereinafter.

The flow of water to flow modulator 10 is regulated by a T-valve 28 which is disposed within the stem 12, upstream of the flow modulator. The T-valve 28 includes a channel 30 which extends along the entire width of the valve and another channel 32, which extends perpendicular to channel 30 from the outside of the valve to the juncture of channel 30. The T-valve is journaled for movement within stem 12 and, by rotation of an appropriate valve stem 34 which extends out from shield 18, channels 30 and 32 are oriented within stem 12. Depending on the orientation of the T-valve, water either flows through stem 12 to flow modulator 10, via channel 30 or, if the valve is rotated 90° in the direction of arrow 36, the water flows through channel 32 and then through channel 30 and is directed out of stem 12 through an appropriate aperture (not shown) in the stem. In this latter position, the T-valve acts as a "stop" which prevents water from reaching the flow modulator. Thus, T-valve 28 acts as a control, either allowing water to reach the flow modulator or preventing water from reaching the flow modulator, depending on the orientation of the T-valve. A third position of the T-valve allows water to flow through both channel 30 and 32 to produce both "straight" and modulated flow.

Figure 2:
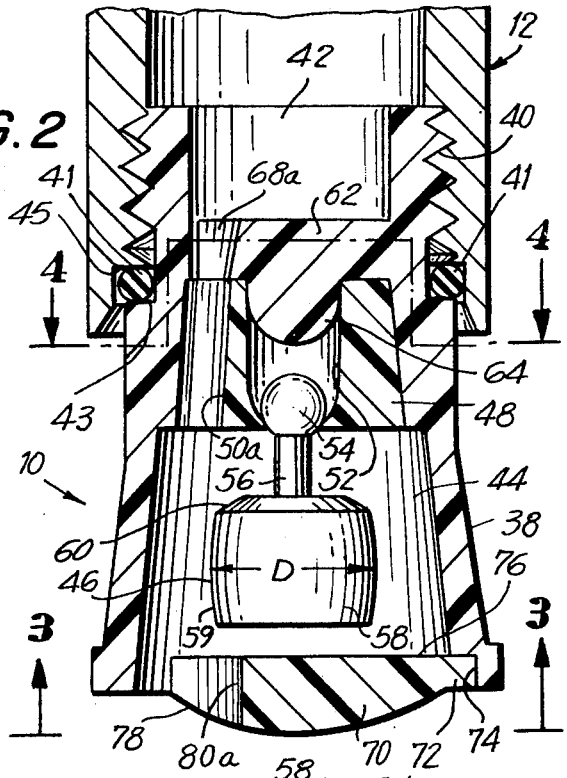
FIG. 2 is a sectional view, enlarged in scale, taken along the line 2—2 of FIG. 1.
Figure 4:
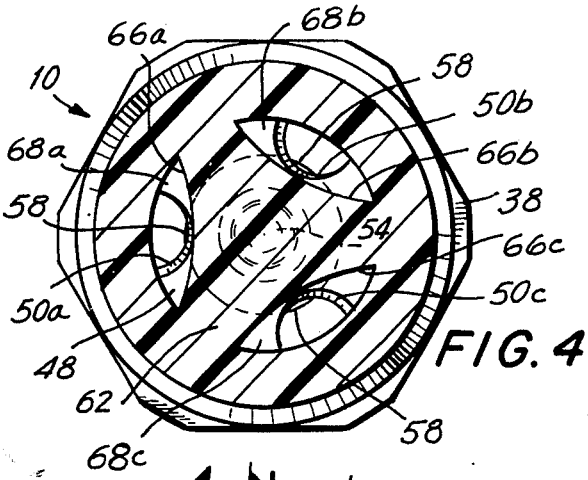
FIG. 4 is a sectional view, taken substantially along the line 4—4 of FIG. 2.
Figure 3:
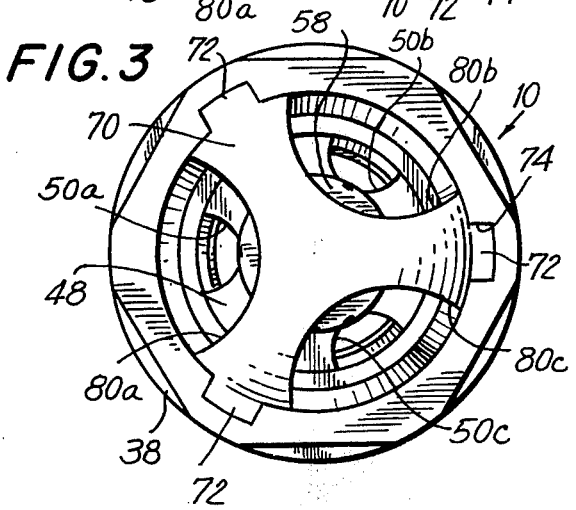
FIG. 3 is a bottom view, taken substantially along the line 3—3 of FIG. 2.

Referring now to FIGS. 2–4 of the drawing, the shower flow modulator 10 is illustrated as including a generally circular housing 38 which is adapted to screw into or otherwise be connected to stem 12 of the shower nozzle, for example, by screw threads 40. The housing defines a top channel, generally designated 42, which opens to stem 12 thereby allowing water from stem 12 to flow into the top channel. To provide a tight seal between stem 12 and the shower flow modulator, a gasket 41 is disposed between shoulders 43 of housing 38 and shoulders 45 of the stem.

The other end of housing 38 defines a generally circular, although somewhat diverging, chamber 44, in which is disposed a hydrodynamically-shaped member, generally designated 46. As explained in more detail hereinafter, hydrodynamically-shaped member 46 functions to alter the direction and intensity of the water which exits from the shower flow modulator, thereby providing the desired massaging effect on the skin of a user.

The shower flow modulator includes a passageway and supporting member 48 which is located between top channel 42 and chamber 44. By way of example, the passageway and supporting member may be designed to frictionally fit within housing 38, between the top channel and the chamber or, alternatively, may be connected to the side walls of the housing by other means, for example, by heat welding. The passageway and supporting member is formed, in the embodiment illustrated in the drawing, with three identically-shaped, arcuate passageways 50*a*, 50*b* and 50*c* which are located 120° from each other, and which open toward the side walls of housing 38. Thus, as shown particularly in FIGS. 3 and 4, the arcuate passageways 50*a*, 50*b* and 50*c*, along with the side walls of housing 38, define three separate passageways for the flow of water from top channel 42 to chamber 44.

Passageway and supporting member 48 also defines an upwardly extending socket 52, located at the center of the passageway and supporting member, adapted to support the hydrodynamically-shaped member by receiving a ball 54 of the hydrodynamically-shaped member. The ball-socket configuration not only supports the hydrodynamically-shaped member 46 within chamber 44 but, as will be explained in detail hereinafter, enables the hydrodynamically-shaped member to move in an oscillating manner beneath the passageways 50*a*, 50*b* and 50*c*, thereby providing the desired massaging effect by varying the flow and direction of the water exiting the various passageways.

Referring to FIG. 2, the hydrodynamically-shaped member also includes a stem 56, which is connected between ball 54 and a generally barrel-shaped body 58. The barrel-shaped body has an upper, beveled edge 60 and the diameter D of the barrel-shaped body is advantageously chosen so that when the hydrodynamically-shaped member is in its center position (illustrated in FIG. 2 of the drawing), the outer edge of the barrel-shaped body extends slightly beneath the three passageways 50*a*, 50*b* and 50*c*, as indicated most clearly in FIG. 4. As will be explained, the barrel-shaped body provides a "foil" surface 59, which tangentially receives the fluid from the passageway, and an upstream surface generally perpendicular to the direction of flow, for example, beveled-edge 60, which interrupts the tangential flow of fluid over foil surface 59.

The shower flow modulator also includes a top plug 62, which may be formed as part of housing 38, and which is located adjacent and upstream of the passageway and supporting member 48. The plug 62 has several functions. First, the top plug 62 is formed to include a downwardly extending plug member 64, which fits into the top of socket 52, therby sealing the socket and preventing water from flowing into the socket cavity. Thus, the top plug acts as a seal for the ball-socket configuration. Second, the plug member 64 aids in keeping member 48 in place due to the friction fit between plug member 64 and socket 52. (Corresponding notches and tabs (not shown) formed on plug 64 and member 48 may also cooperate to angularly orient these two members, with respect to each other.) Third, and as shown most clearly in FIG. 4, the top plug is formed to include three generally arcuately-shaped side walls 66*a*, 66*b* and 66*c* which, along with the side walls of housing 38, define three anti-turbulence feed chambers for the respective passageways of the passageway and supporting member. More particularly, curved side wall 66*a* and the side wall of top channel 42 define an anti-turbulence feed channel 68*a*, which functions to direct water from top channel 42 to passageway 50*a* with somewhat reduced turbulence than would otherwise result if the anti-turbulence feed channel were not there and the water were directed into the passageway directly from the top channel. Similarly, curved side wall 66*b* and curved side wall 66*c* cooperate with the sides of top channel 42 to define respective anti-turbulence feed channels 68*b* and 68*c* for directing water to respective passageways 50*b* and 50*c* at reduced turbulence. Thus, the top of plug 62 not only functions to seal the ball-socket configuration and help keep member 48 in place, but the anti-turbulence feed channels defined therein also function to feed the water to respective passageways 50*a*, 50*b* and 50*c* at reduced turbulence.

As shown in FIG. 3, the shower flow modulator 10 includes a shield 70, which is located at the outlet or bottom end of the shower flow modulator, i.e., beneath the hydrodynamically-shaped member 46. The shield is maintained in place at the exit end of housing 38 by tabs 72 which fit into corresponding cut-outs or notches 74 defined in the housing. Preferably, the shield is shaped to include a substantially flat top surface 76 (see FIG. 2) and a convexly-shaped bottom surface 78. The shield 70 is also formed to include three curved side walls 80*a*, 80*b* and 80*c*, as shown most clearly in FIG. 3. Curved side wall 80*a* is large enough to define, along with the side walls of chamber 44, an exit opening for the stream of jets of water which exit from passageway 50*a*. Similarly, curved side walls 80*b* and 80*c*, along with the side walls of chamber 44, define exit openings for respective passageways 50*b* and 50*c*, thereby allowing the streams of water from these two passageways to exit from the shower flow modulator.

The shield 70 has several functions. As indicated, it provides three exit openings for the water passing through passageways 50*a*, 50*b* and 50*c*. The top surface 76 also functions to deflect random spray, caused by the interaction of the hydrodynamically-shaped member with the water exiting from the three fluid passageways, so that the user is not annoyed by random spray which would otherwise hit the user's face or other parts of the user's body. The shield also provides a safety feature in that if the hydrodynamically-shaped member is torn from socket 52, the shield prevents the member from flying out from the shower flow modulator. Still further, the shield, by some means which is not clearly understood, appears to increase the effectiveness of the massaging action on the skin of a user, which is primarily caused by the interaction of the hydrodynamically-shaped member with the streams of water exiting the three passageways.

Figure 5:
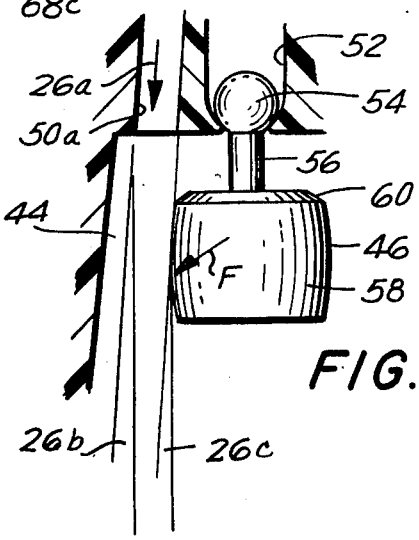
FIG. 5 is a schematic view showing the hydrodynamically-shaped member attracted into a jet or stream of water according to the principles of the present invention.
Figure 6:
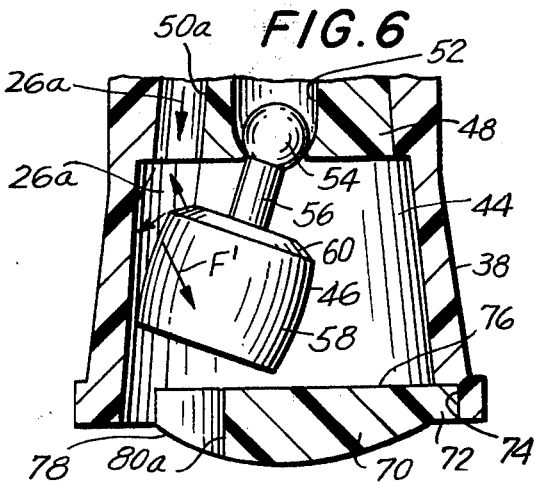
FIG. 6 is a schematic view, similar to that of FIG. 5, but showing the hydrodynamically-shaped member about to be repulsed out of the stream of water, according to the principles of the present invention.

Having now described the overall structure of shower flow modulator 10, its operation will best be understood by reference to FIGS. 5 and 6 of the drawing. These two figures illustrate the movement of hydrodynamically-shaped member 46 relative to a stream or jet of water exiting from a "typical" passageway 50*a*. As will now be explained by reference to these two figures, the shower flow modulator functions to provide its massaging effect by having the hydrodynamically-shaped member 46 move in and out of single or multiple jets of water exiting from the three passageways 50*a*, 50*b* and 50*c*. The action and reaction between the hydrodynamically-shaped member and the stream or jets of water is spontaneous, continuous and operates over a wide flow range.

As indicated previously, the barrel-shaped body 58 of the hydrodynamically-shaped member is chosen so that the barrel-shaped body intercepts the stream 26*a* of water flowing through passageway 50*a*. That is, the fluid flow from the passageway is initially tangential over foil surface 59. As the jet of water 26*a* passes over the slightly curved or barrel-shaped body 58, the fluid flow is accelerated and the fluid direction of the jet is changed. As indicated in FIG. 5, the jet of water contacting the barrel-shaped body 58 over foil surface 59 is initially tangential, indicated by jet 26*b*. The tangential flow of the jet over the foil surface 59 of the barrel-shaped body causes the path of stream 26*a* to change from jet 26*b* to the path of jet 26*c*. This change in direction results in the creation of an attractive force F. The force F causes the hydrodynamically-shaped member 46 to be pulled further beneath passageway 50*a*. The ball-socket mounting of the hydrodynamically-shaped member within passageway and supporting member 48, i.e., the cooperation of socket 52 with ball 54, aids in allowing the barrel shaped body to be pulled into the jet or stream of water, under the influence of force F.

The force F continues to pull the barrel-shaped body into the jet or stream of water 26*a* until the hydrodynamically-shaped member reaches the position illustrated schematically in FIG. 6. In this position, the barrel-shaped body 58 of the hydrodynamically-shaped member has been pulled into jet 26*a* to such an extent that the stream of water is caused to bounce off the barrel-shaped body 58, rather than follow it tangentially, as indicated previously in FIG. 5. Specifically, the tangential flow over foil surface 59 is interrupted by the top of the barrel-shaped member, for example, by the beveled-edge 60 of the barrel-shaped body, which provides a discontinuity in the tangential flow, and now intercepts the water jet. The resulting force now created, force F′, is a repulsive force (in contrast to the attractive force F shown in FIG. 5), and the repulsive force F′ results in an opposite action, moving the barrel-shaped body 58 out of the stream or jet 26*a*. It should be noted that the barrel-shaped body 58 starts moving out of stream 26*a* and continues to do so, even after the beveled-edge 60 moves out of the path of flow of the stream and tangential action, by the action of jet or stream 26*a* flowing over the barrel-shaped body 58, is re-established. One reason for this is the fact that the mass of the barrel-shaped body 58 is chosen to be sufficient so that once repulsive motion caused by repellent force F′ is generated, the barrel-shaped body 58 continues in its travel away from stream 26*a*, until substantial reverse forces are generated on the barrel-shaped body. By way of example, the barrel-shaped body 58 may be fabricated of metal, such as brass, to provide the requisite mass.

It will be appreciated that the effect of the movement of the hydrodynamically-shaped member 46 and, specifically, the barrel-shaped body 58 into and out of the stream 26*a*, as illustrated in FIGS. 5 and 6, is two-fold. In the illustration of FIG. 5, the direction of stream 26*a* is changed on the order of approximately 5°, i.e., the difference in travel between streams or jets 26*b* and 26*c*. For a typical user taking a shower underneath the shower flow modulator, this results in travel of water of about an inch back and forth over the user's skin. In addition, under the effect of the attractive force F which pulls body 58 into the stream, the force of stream 26*a* is also changed. As the barrel-shaped body 58 reaches its outermost position underneath passageway 50*a* (see FIG. 6), the barrel-shaped body deflects and disrupts a substantial amount of stream 26*a*, so that the net force of water reaching the user is substantially reduced. It has been found that the combination of back and forth motion on the skin of the user, combined with the variation of velocity of impact, produces a pleasant and beneficial massaging effect which is much more appealing then the interrupted flow of shower nozzles of the prior art.

The repellent force F′, which causes the barrel-shaped body to be repulsed from stream 26*a* as the barrel-shaped body reaches its full extent of travel beneath passageway 50*a*, causes the barrel-shaped body to swing away until the barrel-shaped body contacts a stream of water (not shown) exiting from another of the passageways, for example, exiting from passageway 50*b*. The attractive-repellent action is then repeated relative to the stream of water from this second passageway; and the barrel-shaped body, after it has been repulsed from the stream of water exiting from passageway 50*b*, then swings back again, either under passageway 50*a* or under the third passageway, 50*c*. It will thus be appreciated that the effect of the attractive-repulsive movement of the hydrodynamically-shaped member is to cause the barrel-shaped body to "oscillate" within chamber 44, so that the barrel-shaped member interrupts the jets or streams of water exiting from the three passageways. This attractive-repulsive action is caused by the flow of fluid tangentially over foil surface 59 and then by interruption of this tangential flow by the beveled-edge, as well as by the location of the passageways relative to the hydrodynamically-shaped member, etc.

In the case of the embodiment illustrated in the drawing wherein three passageways are shown, it is important that the barrel-shaped body 58 should not become lodged between two of the streams. To prevent this from happening, and as indicated hereinbefore, the diameter D of the barrel-shaped body is chosen to be large enough so that the barrel-shaped body slightly protrudes beneath all three passageways when the hydrodynamically-shaped member is in its central or "null" position (see FIG. 4) and the location of the passageways are chosen to be close enough to the central axis of the housing, so that this "stalled" condition is prevented.

It has been found that at very high flow rates of water through the three passageways, the hydrodynamically-shaped member 46 may be acted on by forces which tend to cause the barrel-shaped body 58 to oscillate over a very small arc. To prevent this from happening, in the embodiment illustrated in the drawing, the three passageways 50*a*, 50*b*, and 50*c* are "skewed" from the axial plane one or two degrees (see FIG. 4). This gives a very slight rotary or gyratory component to the forces acting on the barrel-shaped body, so that a certain amount of centrifugal force is generated and retained by the barrel-shaped body, enabling the body to penetrate the fast moving stream of water substantially and to produce the desired modulation of the stream.

It will be appreciated, therefore, that the present invention provides a shower flow modulator which has but one moving part and very few total parts, therby providing ease of operation and decreased manufacturing costs. The shower flow modulator provides a continuous stream of water across the skin of a user, with this flow of water varying in direction and intensity, thereby providing a massaging effect on the user which is less irritating than interrupted water flows provided by massaging nozzles according to the prior art. In addition, the shower flow modulator is not prone to problems of clogging, mineral build-up or excessive wear.

Obviously, numerous modifications will be apparent in light of the above disclosure. For example, the shower flow modulator may be formed with other number of water passageways. Still further, the particular shape of the hydrodynamically-shaped member 46 may be varied, so long as the shape provides attractive-repulsive forces relative to the stream of water flowing over it causing the member to vary the direction and intensity of water emanating from the passageway and eventually onto the skin of a user. Further, although the shower flow modulator has been described as adapted to fit into a conventional shower nozzle, it is to be understood that the modulator may be designed to act as the sole source of water directed to a shower user. Still further, although the modulator has been described as located in a shower nozzle which is wall-mounted, it will be appreciated that the modulator may be inserted into a hand-held or portable shower nozzle. It will be appreciated, therefore, that the above-described embodiment is merely illustrative of the present invention, and other embodiments will be apparent to those skilled in the art without departing from the present invention, as set forth in the appended claims.

What I claim is:

1. A shower flow modulator for varying the intensity and direction of fluid flow exiting from the modulator comprising a housing, a chamber defined in said housing, means for directing a stream of fluid into said chamber, a hydrodynamically-shaped member disposed for movement within said chamber, said hydrodynamically-shaped member shaped so that fluid flowing over said member creates an attractive force which causes said member to be initially attracted into said fluid stream and thereafter creates a repellent force which causes said member to be repulsed from said fluid stream thereby varying the intensity and direction of fluid flow exiting from said chamber.

2. A shower flow modulator according to claim 1 wherein said hydrodynamically-shaped member is caused to oscillate within said chamber by the action of the attractive and repellent forces acting on said member.

3. A shower flow modulator according to claim 2 wherein said means for directing a stream of fluid into said chamber defines at least one fluid passageway for directing fluid against a portion of said hydrodynamically-shaped member.

4. A shower flow modulator according to claim 3 wherein said hydrodynamically-shaped member includes a barrel-shaped body defining a foil surface, and further comprising means for suspending said hydrodynamically-shaped member within said chamber so that the attractive and repellent forces act on said barrel-shaped body to oscillate said barrel-shaped body within said chamber.

5. A shower flow modulator according to claim 4 wherein said hydrodynamically-shaped member includes a socket ball and said means for suspending said hydrodynamically-shaped member within said chamber includes a socket for receiving said socket ball thereby enabling said barrel-shaped body to oscillate within said chamber.

6. A shower flow modulator according to claim 5 wherein said barrel-shaped body extends partially downstream of said passageway so that fluid exiting said passageway is directed tangentially against the foil surface of said barrel-shaped body.

7. A shower flow modulator according to claim 6 wherein said housing defines a top channel for directing fluid toward said passageway.

8. A shower flow modulator according to claim 7 further comprising means disposed in said top channel for reducing the turbulence of fluid presented to said passageway.

9. A fluid flow modulator adapted to fit within the stem of a shower nozzle for varying the intensity and direction of fluid flow from said nozzle comprising a housing defining a top channel and a chamber, means adapted to connect said housing to the stem of a shower nozzle, means defining at least two passageways for directing fluid from said top channel into said chamber, a hydrodynamically-shaped member, means for suspending said hydrodynamically-shaped member within said chamber and within the path of travel of fluid exiting from said passageways, said hydrodynamically-shaped member defining a barrel-shaped body which interacts with fluid flowing from said passageways causing said barrel-shaped body to be attracted into and repulsed from the path of the fluid flowing from said passageway thereby varing the intensity and direction of flow of fluid from said modulator without interrupting the overall flow of fluid from said modulator.

10. A fluid flow modulator according to claim 9 wherein the barrel-shaped body extends partially in the path of fluid exiting from said passageways when said hydrodynamically-shaped member is in a central position so that the flow of fluid over said barrel-shaped body is initially tangential.

11. A fluid flow modulator according to claim 10 wherein said passageways are skewed one to the other so that flow of fluid from said passageways exerts a gyratory force of said barrel-shaped body.

12. A fluid flow modulator according to claim 10 wherein said barrel-shaped body includes a beveled edge adapted to be pulled into the path of fluid flowing from said passageways for interrupting the flow of fluid over the barrel-shaped body thereby repulsing the barrel-shaped body from the path of fluid flowing from said passageways by interrupting the tangential flow.

13. A fluid flow modulator according to claim 10 further comprising means for reducing the turbulence of fluid flowing from said top channel to said passageways.

14. A fluid flow modulator according to claim 10 further comprising shield means for maintaining said hydrodynamically-shaped member within said chamber, said shield means enabling the flow of fluid from said passageways to exit said modulator.

15. A fluid flow modulator comprising a hydrodynamically-shaped member, means for suspending said hydrodynamically-shaped member for movement into and out of a stream of fluid to vary the intensity and direction of flow of said stream, said hydrodynamically-shaped member including a first foil surface and a second surface, said hydrodynamically-shaped member positioned within said modulator so that flow of fluid over said first foil surface is initially generally tangential to said first foil surface resulting in said hydrodynamically-shaped member being attracted into said stream until said second surface is pulled into the stream causing interruption of the generally tangential flow over said first foil surface and repulsion of said hydrodynamically-shaped member out of said stream.

16. A fluid flow modulator adapted to connect with a nozzle for varying the intensity and direction of fluid flowing from said nozzle comprising a housing defining a channel and a chamber, means for connecting said housing to the nozzle, means defining at least two passageways for directing fluid from said channel into said chamber, a hydrodynamically-shaped member, means for mounting said hydrodynamically-shaped member within said chamber and within the path of travel of fluid exiting from said passageways, said hydrodynamically-shaped member shaped so that fluid flowing over said hydrodynamically-shaped member creates forces which cause said hydrodynamically-shaped member to be continuously attracted into and repulsed from the path of fluid flowing from said paassageways, thereby varying the intensity and direction of fluid flowing from said modulator without interrupting the overall flow of fluid from said modulator.

17. A fluid flow modulator according to claim 16 wherein the hydrodynamically-shaped member extends partially in the path of fluid exiting from said passageways when said hydrodynamically-shaped member is in a central position in the chamber so that fluid flow over said hydrodynamically-shaped member is tangential thereby causing said hydrodynamically-shaped member to be attracted into the path of fluid flowing from one of said passageways.

18. A fluid flow modulator according to claim 17 wherein said hydrodynamically-shaped member has a surface which when in the path of fluid flowing from said one passageway interrupts the tangential flow of fluid over the hydrodynamically-shaped member thereby repulsing the hydrodynamically shaped member from the path of fluid flowing from said one passageway.

19. A fluid flow modulator adapted to cooperate with a nozzle for varying the intensity and direction of fluid from said nozzle comprising means for connecting the modulator to the nozzle, a hydrodynamically-shaped member, means defining at least two passageways for directing fluid from the nozzle toward said hydrodynamically-shaped member, means for mounting said hydrodynamically-shaped member within the path of flow of fluid exiting from said passageways, said hydrodynamically-shaped member shaped such that fluid flowing over said hydrodynamically-shaped member creates an attractive force which causes said hydrodynamically-shaped member to be attracted into the path of fluid exiting from one of the passageways and thereafter creates a repellent force which causes said hydrodynamically-shaped member to be repulsed from said path of fluid and directed into the path of fluid exiting from another of said passageways.

20. A fluid flow modulator according to claim 19 wherein said hydrodynamically-shaped member extends partially within the path of fluid exiting from at least one of said passageways when said hydrodynamically-shaped member is in a central position so that fluid flow from said one passageway over said hydrodynamically-shaped member is initially tangential thereby causing said hydrodynamically-shaped member to be attracted into the path of fluid flowing from said one passageway, the hydrodynamically-shaped member further defining a surface adapted to be pulled into the path of fluid flowing from said one passageway, said surface interrupting the tangential flow of fluid over said hydrodynamically-shaped member and resulting in said hydrodynamically-shaped member being repulsed from said path of fluid flowing from said one passageway.

* * * * *